US007502739B2

(12) United States Patent
Saito et al.

(10) Patent No.: US 7,502,739 B2
(45) Date of Patent: Mar. 10, 2009

(54) INTONATION GENERATION METHOD, SPEECH SYNTHESIS APPARATUS USING THE METHOD AND VOICE SERVER

(75) Inventors: Takashi Saito, Tokyo-to (JP); Masaharu Sakamoto, Yokohama (JP)

(73) Assignee: International Business Machines Corporation, Armonk, NY (US)

( * ) Notice: Subject to any disclaimer, the term of this patent is extended or adjusted under 35 U.S.C. 154(b) by 943 days.

(21) Appl. No.: 10/784,044

(22) Filed: Jan. 24, 2005

(65) Prior Publication Data

US 2005/0114137 A1 May 26, 2005

(51) Int. Cl.
*G10L 13/00* (2006.01)
*G10L 13/06* (2006.01)

(52) U.S. Cl. ..... 704/260; 704/266; 704/268

(58) Field of Classification Search ..... 704/258, 704/260, 266, 268
See application file for complete search history.

(56) References Cited

U.S. PATENT DOCUMENTS

| | | | | |
|---|---|---|---|---|
| 5,671,330 | A * | 9/1997 | Sakamoto et al. | 704/268 |
| 5,715,368 | A * | 2/1998 | Saito et al. | 704/268 |
| 5,740,320 | A * | 4/1998 | Itoh | 704/267 |
| 5,905,972 | A * | 5/1999 | Huang et al. | 704/268 |
| 6,260,016 | B1 * | 7/2001 | Holm et al. | 704/260 |
| 6,289,085 | B1 * | 9/2001 | Miyashita et al. | 379/88.02 |
| 6,334,106 | B1 * | 12/2001 | Mizuno et al. | 704/260 |
| 6,499,014 | B1 * | 12/2002 | Chihara | 704/260 |
| 6,529,874 | B2 * | 3/2003 | Kagoshima et al. | 704/269 |
| 6,751,592 | B1 * | 6/2004 | Shiga | 704/258 |
| 6,975,987 | B1 * | 12/2005 | Tenpaku et al. | 704/258 |
| 7,035,794 | B2 * | 4/2006 | Sirivara | 704/219 |
| 2003/0061051 | A1 * | 3/2003 | Kondo et al. | 704/263 |
| 2006/0224380 | A1 * | 10/2006 | Hirabayashi et al. | 704/207 |
| 2006/0271367 | A1 * | 11/2006 | Hirabayashi et al. | 704/261 |

FOREIGN PATENT DOCUMENTS

| | | |
|---|---|---|
| JP | PUPA 10-116089 | 5/1998 |
| JP | PUPA 11-095783 | 9/1999 |
| JP | PUPA 2000-250570 | 9/2000 |
| JP | PUPA 2001-034284 | 9/2001 |

OTHER PUBLICATIONS

Kobayashi et al., "Wavelet Analysis Used In Text-to-Speech Synthesis", IEEE Transactions on Circuits and Systems—II. Analog and Digital Signal Processing, vol. 45, No. 8, Aug. 1998, pp. 1125 to 1129.*

Black, et al, "Limited Domain Synthesis", Proceedings of ICSLP, Oct. 2000.

Donovan, et al, "Phrase Splicing and Variable Substitution Using the IBM Trainable Speech Synthesis System", Proceedings of ICASSP, 1999, pp. 373-376.

* cited by examiner

*Primary Examiner*—Martin Lerner
(74) *Attorney, Agent, or Firm*—Anne Vachon Doughert

(57) ABSTRACT

In generation of an intonation pattern of a speech synthesis, a speech synthesis system is capable of providing a highly natural speech and capable of reproducing speech characteristics of a speaker flexibly and accurately by effectively utilizing FO patterns of actual speech accumulated in a database. An intonation generation method generates an intonation of synthesized speech for text by estimating, based on language information of the text and based on the estimated outline of the intonation, and then selects an optimum intonation pattern from a database which stores intonation patterns of actual speech. Speech characteristics recorded in advance are reflected in an estimation of an outline of the intonation pattern and selection of a waveform element of a speech.

2 Claims, 12 Drawing Sheets

F0 SHAPE TARGET

OPTIMUM F0 SHAPE ELEMENT

FIG. 9

```
Tmp#: 33/280 (nCand=3) Type:ACC=0/Mora=3 SOREWA
    [In  ] ( -1/ -1) 1 <  0/  3> 1 (  0/  5)
      ENVIRONMENTAL ATTRIBUTE OF INPUTTED PHRASE (PRECEDENT ACCENT PHRASE
    =>TYPE/LENGTH, EXISTENCE OF PAUSE, CONCERNED ACCENT PHRASE TYPE/LENGTH,
      EXISTENCE OF PAUSE, SUBSEQUENT ACCENT PHRASE TYPE/LENGTH)
    [* 33] (  2/  5) 1 <  0/  3> 1 (  1/  5)  pd=0  449  korega
     => ATTRIBUTE INFORMATION OF OBTAINED SHAPE ELEMENT
Tmp#: 100/330 (nCand=3) Type:ACC=0/Mora=5 DORONUMANO
    [In  ] (  0/  3) 1 <  0/  5> 0 (  1/  3)
    [*100] (  0/  4) 0 <  0/  5> 1 (  3/  4)  pd=0  942  yorokobimo
Tmp#: 277/353 (nCand=44) Type:ACC=1/Mora=3 YO:NA
    [In  ] (  0/  5) 0 <  1/  3> 0 (  0/  4)
    [*277] (  0/  4) 0 <  1/  3> 1 (  2/  6)  pd=0 2711  ma^kki
Tmp#: 128/431 (nCand=3) Type:ACC=0/Mora=4 GYA_OKYO:
    [In  ] (  1/  3) 0 <  0/  4> 0 (  0/  2)
    [*128] (  0/  2) 0 <  0/  4> 0 (  2/  3)  pd=0 1028  shukkin
Tmp#:  3/155 (nCand=49) Type:ACC=0/Mora=2 KARA
    [In  ] (  0/  4) 0 <  0/  2> 1 (  5/  7)
    [*  3] (  1/  4) 0 <  0/  2> 1 (  1/  4)  pd=0  103  yobi
Tmp#:  1/23 (nCand=1) Type:ACC=5/Mora=7 NUKEDASHITA|TO
    [In  ] (  0/  2) 1 <  5/  7> 0 (  0/  2)
    [*  1] (  1/  3) 1 <  5/  7> 1 ( -1/ -1)  pd=2  5  nejimageta^noda
Tmp#: 30/155 (nCand=11) Type:ACC=0/Mora=2 IU
    [In  ] (  5/  7) 0 <  0/  2> 1 (  3/  7)
    [* 30] (  1/  4) 0 <  0/  2> 0 (  0/  5)  pd=0  696  iu
Tmp#: 7/37  (nCand=1) Type:ACC=3/Mora=7 SETSUNA|HODONO
    [In  ] (  0/  2) 1 <  3/  7> 0 (  0/  4)
    [*  7] ( -1/ -1) 1 <  3/  7> 0 (  0/  5)  pd=3  1080  juppu^nkanno
Tmp#: 83/431 (nCand=13) Type:ACC=0/Mora=4 GA_NBO:
    [In  ] (  3/  7) 0 <  0/  4> 0 (  2/  4)
    [* 83] ( -1/ -1) 1 <  0/  4> 0 (  1/  5)  pd=0  700  hanbai
Tmp#: 105/127 (nCand=1) Type:ACC=2/Mora=4 DAROOKA
    [In  ] (  0/  4) 0 <  2/  4> 1 ( -1/ -1)
    [*105] (  0/  4) 0 <  2/  4> 0 (  0/  2)  pd=4  2615  mie^ruto
```

INTONATION GENERATION METHOD, SPEECH SYNTHESIS APPARATUS USING THE METHOD AND VOICE SERVER

TECHNICAL FIELD

The present invention relates to a speech synthesis method and a speech synthesis apparatus, and particularly, to a speech synthesis method having characteristics in a generation method for a speech intonation, and to a speech synthesis apparatus.

BACKGROUND OF THE INVENTION

In a speech synthesis (text-to-speech synthesis) technology by a text synthesis technique of audibly outputting text data, it has been a great challenge to generate a natural intonation close to that of human speech.

A control method for an intonation, which has been widely used heretofore, is a method using a generation model of an intonation pattern by superposition of an accent component and a phrase component, which is represented by the Fujisaki Model. It is possible to associate this model with a physical speech phenomenon, and this model can flexibly express intensities and positions of accents, a retrieval of a speech tone and the like.

However, it has been complicated and difficult for this type of model to be associated with linguistic information of voice. Accordingly, it has been difficult to precisely control parameters which control accents, a magnitude of a speech tone component, temporal arrangement thereof and the like, which are actually used in the case of a speech synthesis. Consequently, in many cases, the parameters have been simplified excessively, and only fundamental prosodic characteristics have been expressed. This has become a cause of difficulty controlling speaker characteristics and speech styles in the conventional speech synthesis. For this, in recent years, a technique using a database (corpus base) established based on actual speech phenomena has been proposed in order to generate a more natural prosody.

As this type of background art, for example, there is a technology disclosed in the gazette of Japanese Patent Laid-Open No. 2000-250570 and a technology disclosed in the gazette of Japanese Patent Laid-Open No. Hei 10 (1998)-116089. In the technologies described in these gazettes, from among patterns of fundamental frequencies (F0) of intonations in actual speech, which are accumulated in a database, an appropriate F0 pattern is selected. The selected F0 pattern is applied to text that is a target of the speech synthesis (hereinafter, referred to as target text) to determine an intonation pattern, and the speech synthesis is performed. Thus, speech synthesis by a good prosody is realized as compared with the above-described generation model of an intonation pattern by superposition of an accent component and a tone component.

Any of such speech synthesis technologies using the F0 patterns determines or estimates a category which defines a prosody based on language information of the target text (e.g., parts of speech, accent positions, accent phrases and the like). The FO pattern belongs to the prosodic category in the database. Then this FO pattern is applied to the target text to determine the intonation pattern.

Moreover, when the plurality of F0 patterns belong to a predetermined prosodic category, one representative F0 pattern is selected by an appropriate method such as equation of the F0 patterns and adoption of the proximate sample to a mean value thereof (modeling), and is applied to the target text.

However, as described above, the conventional speech synthesis technology using the F0 patterns directly associates the language information and the F0 patterns with each other_in accordance with the prosodic category to determine the intonation pattern of the target text; and, therefore, the conventional speech synthesis technology has had limitations, such that quality of a synthesized speech depends on the determination of the prosodic category for the target text and whether an appropriate F0 pattern can be applied to target text incapable of being classified into prosodic categories of the F0 patterns in the database.

Furthermore, the language information of the target text, that is, such information concerning the positions of accents and morae and concerning whether or not there are pauses (silence sections) before and after a voice, has great effect on the determination of the prosodic category to which the target text applies. Hence, there has occurred a waste that an F0 pattern cannot be applied because these pieces of language information are different even if the F0 pattern has a pattern shape highly similar to that of intonation in actual speech.

Moreover, the conventional speech synthesis technology described above performs the equation and modeling of the pattern shape itself while putting importance on ease of treating the F0 pattern as data, and accordingly, has had limitations in expressing F0 variations of the database.

Specifically, a speech to be synthesized is undesirably homogenized into a standard intonation such as in a recital, and it has been difficult to flexibly synthesize a speech having dynamic characteristics (e.g., voices in an emotional speech, or a speech in dubbing, as characterizing a specific character).

Incidentally, while the text-to-speech synthesis is a technology aimed to synthesize a speech for an arbitrary sentence, there are many to which it is possible to apply relatively limited vocabularies and sentence patterns among fields to which the synthesized speech is actually applied. For example, response speeches in a Computer Telephony Integration system or car navigation system and a response in a speech dialogue function of a robot are typical examples of the fields.

In the application of the speech synthesis technology to these fields, it is also frequent that actual speech (recorded speech) is preferred over synthesized speech, based on a strong demand for the speech to be natural. Actual speech data can be prepared in advance for determined vocabularies and sentence patterns. However, a role of the synthesized speech is extremely large when taking a view of the ease of dealing with the synthesis of unregistered words, of additions and changes to the vocabularies and sentence patterns, and the like, and further, of extension to an arbitrary sentence.

From the above background, a method for enhancing the naturalness of the synthesized speech by use of recorded speech has been studied in the case of a task in which comparatively limited vocabularies are used. Examples of technology for mixing recorded speech and synthesized speech, for example, are disclosed in the following documents 1 to 3.

Document 1: A. W. black et al., "Limited Domain Synthesis," Proc. of ICSLP 2000.

Document 2: R. E. Donovan et al., "Phrase Splicing and Variable Substitution Using the IBM Trainable Speech Synthesis System," Proc. of ICASSP 2000.

Document 3: Katae et al., "Specific Text-to-speech System Using Sentence-prosody Database," Proc. of the Acoustical Society of Japan, 2-4-6, Mar. 1996.

In the conventional technology disclosed in Document 1 or 2, the intonation of the recorded speech is basically utilized as it is. Hence, it is necessary to record in advance a phrase for use as the recorded speech in a context to be actually used. Meanwhile, the conventional technology disclosed in Document 3 is one of extracting in advance parameters of a model for generating the F0 pattern from an actual speech and of applying the extracted parameters to synthesis of a specific sentence having variable slots. Hence, it is possible to generate intonations also for different phrases if sentences having the phrases are in the same format, but there remain limitations that the technology can deal with only the specific sentence.

Here, consideration is made for insertion of the phrase of the synthesized speech between the phrases of the recorded speeches and connection thereof before and after the phrase of the recorded speech. Then, considering various speech behaviors in actual individual speeches, such as fluctuations, degrees of emphasis and emotion, and differences in intention of speeches, it cannot be said that an intonation of each synthesized phrase with a fixed value is always adapted to an individual environment of the recorded phrase.

However, in the conventional technologies disclosed in the foregoing Documents 1 to 3, these speech behaviors in the actual speeches are not considered, which results in great limitations to the intonation generation in the speech synthesis.

In this connection, it is an object of the present invention to realize a speech synthesis system which is capable of providing highly natural speech and is capable of reproducing speech characteristics of a speaker flexibly and accurately in generation of an intonation pattern of speech synthesis.

Moreover, it is another object of the present invention to, in the speech synthesis, effectively utilize F0 patterns of actual speeches accumulated in a database (corpus base) thereof in intonations of actual speeches by narrowing the F0 patterns without depending on a prosodic category.

Furthermore, it is still another object of the present invention to mix intonations of a recorded speech and synthesized speech to join the two smoothly.

SUMMARY OF THE INVENTION

In an intonation generation method for generating an intonation in computer speech synthesized, the method estimates an outline of an intonation based on language information of the text, which is an object of the speech synthesis; selects an intonation pattern from a database accumulating intonation patterns of actual speech based on the outline of the intonation; and defines the selected intonation pattern as the intonation pattern of the text.

Here, the outline of the intonation is estimated based on prosodic categories classified by the language information of the text.

Further, in the intonation creation method, a frequency level of the selected intonation pattern is adjusted based on the estimated outline of the intonation after selecting the intonation pattern.

Also, in an intonation generation method for generating an intonation in a speech synthesis by a computer, the method comprises the steps of:

estimating an outline of the intonation for each assumed accent phrase configuring text as a target of the speech synthesis and storing an estimation result in a memory;

selecting an intonation pattern from a database accumulating intonation patterns of actual speech based on the outline of the intonation; and connecting the intonation pattern for each assumed accent phrase selected to another.

More preferably, in a case of estimating an outline of an intonation of the assumed accent phrase, which is a predetermined one, when another assumed accent phrase is present immediately before the assumed accent phrase in the text, the step of estimating an outline of the intonation and storing an estimation result in memory estimates the outline of the intonation of the predetermined assumed accent phrase in consideration of an estimation result of an outline of an intonation for the other assumed accent phrase immediately therebefore.

Furthermore, preferably, when the assumed accent phrase is present in a phrase of a speech stored in a predetermined storage apparatus, the step of estimating an outline of the intonation and storing an estimation result in memory acquires information concerning an intonation of a portion corresponding to the assumed accent phrase of the phrase from the storage device, and defines the acquired information as an estimation result of an outline of the intonation.

And further, the step of estimating an outline of the intonation includes the steps of:

when another assumed accent phrase is present immediately before a predetermined assumed accent phrase in the text, estimating an outline of an intonation of the assumed accent phrase based on an estimation result of an outline of an intonation for the other assumed accent phrase immediately therebefore; and when another assumed accent phrase corresponding to the phrase of the speech recorded in advance, the phrase being stored in the predetermined storage device, is present either before and after a predetermined assumed accent phrase in the text, estimating an outline of an intonation for the assumed accent phrase based on an estimation result of an outline of an intonation for the other assumed accent phrase corresponding to the phrase of the recorded speech.

In addition, the step of selecting an intonation pattern includes the steps of:

from among intonation patterns of actual speech, the intonation patterns being accumulated in the database, selecting an intonation pattern in which an outline is close to an outline of an intonation of the assumed accent phrase between starting and termination points; and among the selected intonation patterns, selecting an intonation pattern in which a distance of a phoneme class for the assumed accent phrase is smallest.

In addition, the present invention can be realized as a speech synthesis apparatus, comprising: a text analysis unit which analyzes text, that is the object of processing and acquires language information therefrom; a database which accumulates intonation patterns of actual speech; a prosody control unit which generates a prosody for audibly outputting the text; and a speech generation unit which generates speech based on the prosody generated by the prosody control unit, wherein the prosody control unit includes: an outline estimation section which estimates an outline of an intonation for each assumed accent phrase configuring the text based on the language information acquired by the text analysis unit; a shape element selection section which selects an intonation pattern from the database based on the outline of the intonation, the outline having been estimated by the outline estimation section; a shape element selection section which selects the intonation pattern from the database based on the outline of the intonation estimated by this outline estimation section; and a shape element connection section which connects the intonation pattern for each assumed accent phrase to the other, the intonation pattern having been selected by the shape element selection section, and generates an intonation pattern of an entire body of the text.

More specifically, the outline estimation section defines the outline of the intonation at least by a maximum value of a frequency level in a segment of the assumed accent phrase and relative level offsets in a starting point and termination point of the segment.

In addition, not dependent on a prosody category, the shape element selection section selects the one that approximates in shape the outline of the information as an intonation pattern, from among the whole body of intonation patterns of actual speech accumulated in the database.

Further, the shape element connection section connects the intonation pattern for each assumed accent phrase to the other, the intonation pattern having been selected by the shape element selection section, after adjusting a frequency level of the assumed accent phrase based on the outline of the intonation, the outline having been estimated by the outline estimation section.

Further, the speech synthesis apparatus can further comprise another database which stores information concerning intonations of a speech recorded in advance. In this case, when the assumed accent phrase is present in a recorded phrase registered in the other database, the outline estimation section acquires information concerning an intonation of a portion corresponding to the assumed accent phrase of the recorded phrase from the other database.

In addition, the present invention can be realized as a speech synthesis apparatus, comprising:

a text analysis unit which analyzes text, which is an object of processing, and acquires language information therefrom;

a database which stores intonation patterns of an actual speech prepared in plural based on speech characteristics;

a prosody control unit which generates a prosody for audibly outputting the text; and a speech generation unit which generates a speech based on the prosody generated by the prosody control unit.

The speech synthesis apparatus on which the speech characteristics are reflected is performed by use of the databases in a switching manner.

Further, the present invention can be realized as a speech synthesis apparatus for performing a text-to-speech synthesis, comprising:

a text analysis unit which analyzes text, that is the object of processing, and acquires language information therefrom;

a first database that stores information concerning speech characteristics;

a second database which stores information concerning a waveform of a speech recorded in advance;

a synthesis unit selection unit which selects a waveform element for a synthesis unit of the text; and a speech generation unit which generates a synthesized speech by coupling the waveform element selected by the synthesis unit selection unit to the other, wherein the synthesis unit selection unit selects the waveform element for the synthesis unit of the text, the synthesis unit corresponding to a boundary portion of the recorded speech, from the information of the database.

Furthermore, the present invention can be realized as a program that allows a computer to execute the above-described method for creating an intonation, or to function as the above-described speech synthesis apparatus. This program can be provided by being stored in a magnetic disk, an optical disk, a semiconductor memory or other recording media and then distributed, or by being delivered through a network.

Furthermore, the present invention can be realized by a voice server which mounts a function of the above-described voice synthesis apparatus and provides a telephone-ready service.

BRIEF DESCRIPTION OF THE DRAWINGS

Hereafter, the present invention will be explained based on the embodiments shown in the accompanying drawings.

FIG. 9 is a table showing the optimum F0 shape elements selected for each assumed accent phrase in target text of FIG. 8 by use of this embodiment.

DETAILED DESCRIPTION OF THE INVENTION

The present invention will be described in detail based on embodiments shown in the accompanying drawings.

Figure 1:
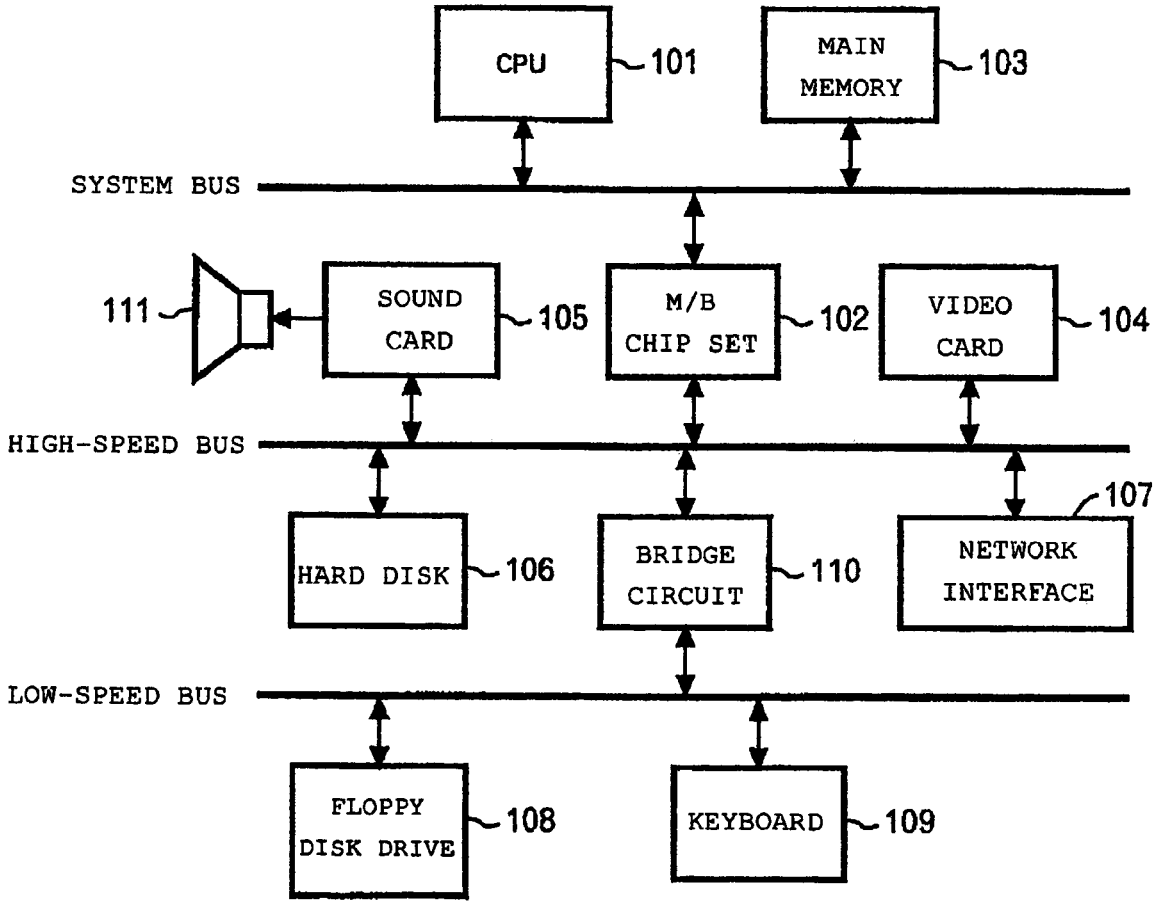
FIG. 1 is a view schematically showing an example of a hardware configuration of a computer apparatus suitable for realizing a speech synthesis technology of this embodiment.

FIG. 1 shows an example of a hardware configuration of a computer apparatus suitable for realizing a speech synthesis technology of this embodiment.

The computer apparatus shown in FIG. 1 includes a CPU (central processing unit) 101, an M/B (motherboard) chip set 102 and a main memory 103, both of which are connected to the CPU 101 through a system bus, a video card 104, a sound card 105, a hard disk 106, and a network interface 107, which are connected to the M/B chip set 102 through a high-speed bus such as a PCI bus, and a floppy disk drive 108 and a keyboard 109, both of which are connected to the M/B chip set 102 through the high-speed bus, a bridge circuit 110 and a low-speed bus such as an ISA bus. Moreover, a speaker 111 which outputs a voice is connected to the sound card 105.

Note that FIG. 1 only shows the configuration of computer apparatus which realizes this embodiment for an illustrative purpose, and that it is possible to adopt other various system configurations if this embodiment is applicable thereto. For example, instead of providing the sound card 105, a sound mechanism can be provided as a function of the M/B chip set 102.

Figure 2:
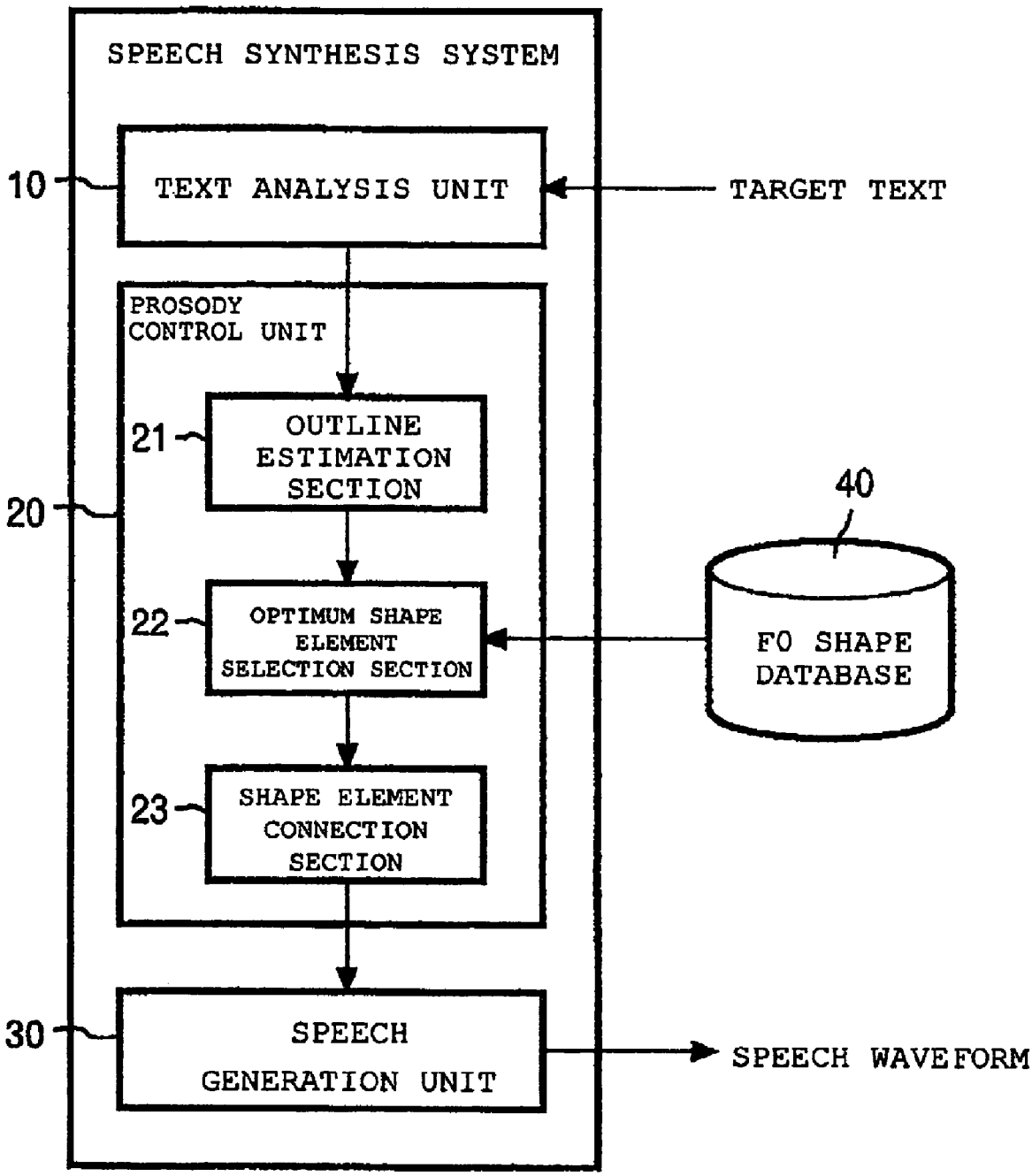
FIG. 2 is a view showing a configuration of a speech synthesis system according to this embodiment, which is realized by the computer apparatus shown in FIG. 1.

FIG. 2 shows a configuration of a speech synthesis system according to the embodiment which is realized by the computer apparatus shown in FIG. 1. Referring to FIG. 2, the speech synthesis system of this embodiment includes a text analysis unit 10 which analyzes text that is a target of a speech synthesis, a prosody control unit 20 for adding a rhythm of speech by the speech synthesis, a speech generation unit 30 which generates a speech waveform, and an F0 shape database 40 which accumulates F0 patterns of intonations by actual speech.

The text analysis unit 10 and the prosody control unit 20, which are shown in FIG. 2, are virtual software blocks realized by controlling the CPU 101 by use of a program expanded in the main memory 103 shown in FIG. 1. This program which controls the CPU 101 to realize these functions can be provided by being stored in a magnetic disk, an optical disk, a semiconductor memory or other recording media and then distributed, or by being delivered through a network. In this embodiment, the program is received through the network interface 107, the floppy disk drive 108, a CD-ROM drive (not shown) or the like, and then stored in the hard disk 106. Then, the program stored in the hard disk 106 is read into the main memory 103 and expanded, and is executed by the CPU 101, thus realizing the functions of the respective constituent elements shown in FIG. 2.

The text analysis unit 10 receives text (received character string) to be subjected to the speech analysis, and performs linguistic analysis processing, such as syntax analysis. Thus, the received character string that is a processing target is parsed for each word, and is imparted with information concerning pronunciations and accents.

Based on a result of the analysis by the text analysis unit 10, the prosody control unit 20 performs processing for adding a rhythm to the speech, namely, determining a pitch, length and intensity of a sound for each phoneme configuring a speech and setting a position of a pause. In this embodiment, in order to execute this processing, an outline estimation section 21, an optimum shape element selection section 22 and a shape element connection section 23 are provided as shown in FIG. 2.

The speech generation unit 30 is realized, for example, by the sound card 105 shown in FIG. 1, and upon receiving a result of the processing by the prosody control unit 20, it performs processing of connecting the phonemes in response to synthesis units accumulated as syllables to generate a speech waveform (speech signal). The generated speech waveform is outputted as a speech through the speaker 111.

The F0 shape database 40 is realized by, for example, the hard disk 106 shown in FIG. 1, and accumulates F0 patterns of intonations by actual speeches collected in advance while classifying the F0 patterns into prosodic categories. Moreover, plural types of the F0 shape databases 40 can be prepared in advance and used in a switching manner in response to styles of speeches to be synthesized. For example, besides an F0 shape database 40 which accumulates F0 patterns of standard recital tones, F0 shape databases which accumulate F0 patterns in speeches with emotions such as cheerful-tone speech, gloom-tone speech, and speech containing anger can be prepared and used. Furthermore, an F0 shape database that accumulates F0 patterns of special speeches characterizing special characters, in dubbing an animation film and a movie, can also be used.

Next, the function of the prosody control unit 20 in this embodiment will be described in detail. The prosody control unit 20 takes out the target text analyzed in the text analysis unit 10 for each sentence, and applies thereto the F0 patterns of the intonations, which are accumulated in the F0 shape database 40, thus generating the intonation of the target text (the information concerning the accents and the pauses in the prosody can be obtained from the language information analyzed by the text analysis unit 10).

In this embodiment, when extracting the F0 pattern of the intonation of the text to be subjected to the speech synthesis from the intonation patterns by the actual speech, which is accumulated in the database, a detection that does not depend on the prosodic categories is performed. However, also in this embodiment, the classification itself for the text, which depends on the prosodic categories, is required for the estimation of the F0 shape target by the outline estimation section 21.

However, the language information, such as the positions of the accents, the morae, and whether or not there are pauses before and after a voice, has great effect on the selection of the prosodic category. Accordingly, when the prosodic category is utilized also in the case of extracting the F0 pattern, besides the pattern shape in the intonation, elements such as the positions of the accents, the morae and the presence of the pauses will have an effect on the retrieval, which may lead to missing of the F0 pattern having the optimum pattern shape in the retrieval.

At the stage of determining the F0 pattern, the retrieval only for pattern shape, which is provided by this embodiment and does not depend on the prosodic categories, is useful. Here, an F0 shape element unit that is a unit when the F0 pattern is applied to the target text in the prosody control of this embodiment is defined.

In this embodiment, no matter whether or not an accent phrase is formed in the actual speech, an F0 segment of the actual speech, which is cut out by a linguistic segment unit capable of forming the accent phrase (hereinafter, this segment unit will be referred to as an assumed accent phrase), is defined as a unit of the F0 shape element. Each F0 shape element is expressed by sampling an F0 value (median of three points) in a vowel center portion of configuration morae. Moreover, the F0 patterns of the intonations in the actual speech with this F0 shape element taken as a unit are stored in the F0 shape database 40.

In the prosody control unit 20 of this embodiment, the outline estimation section 21 receives language information (accent type, phrase length (number of morae), and a phoneme class of morae configuring phrase) concerning the assumed accent phrases given as a result of the language processing by the text analysis unit 10 and information concerning the presence of a pause between the assumed accent phrases. Then, the prosody control unit 20 estimates the outline of the F0 pattern for each assumed accent phrase based on these pieces of information. The estimated outline of the F0 pattern is referred to as an F0 shape target.

Here, an F0 shape target of a predetermined assumed accent phrase is defined by three parameters, which are: the maximum value of a frequency level in the segments of the assumed accent phrase (maximum F0 value); a relative level offset in a pattern starting endpoint from the maximum F0 value (starting end offset); and a relative level offset in a pattern termination endpoint from the maximum F0 value (termination end offset).

Specifically, the estimation of the F0 shape target comprises estimating these three parameters by use of a statistical model based on the prosodic categories classified by the above-described language information. The estimated F0 shape target is temporarily stored in the cache memory of CPU 101 and the main memory 103, which are shown in FIG. 1.

Moreover, in this embodiment, limitations on the speech are incorporated in an estimation model, separately from the above-described language information. Specifically, an assumption that intonations realized until immediately before a currently assumed accent phrase have an effect on the intonation level and the like of the next speech is adopted, and an estimation result for the segment of the assumed accent phrase immediately therebefore is reflected on estimation of the F0 shape target for the segment of the assumed accent phrase under the processing.

Figure 3:
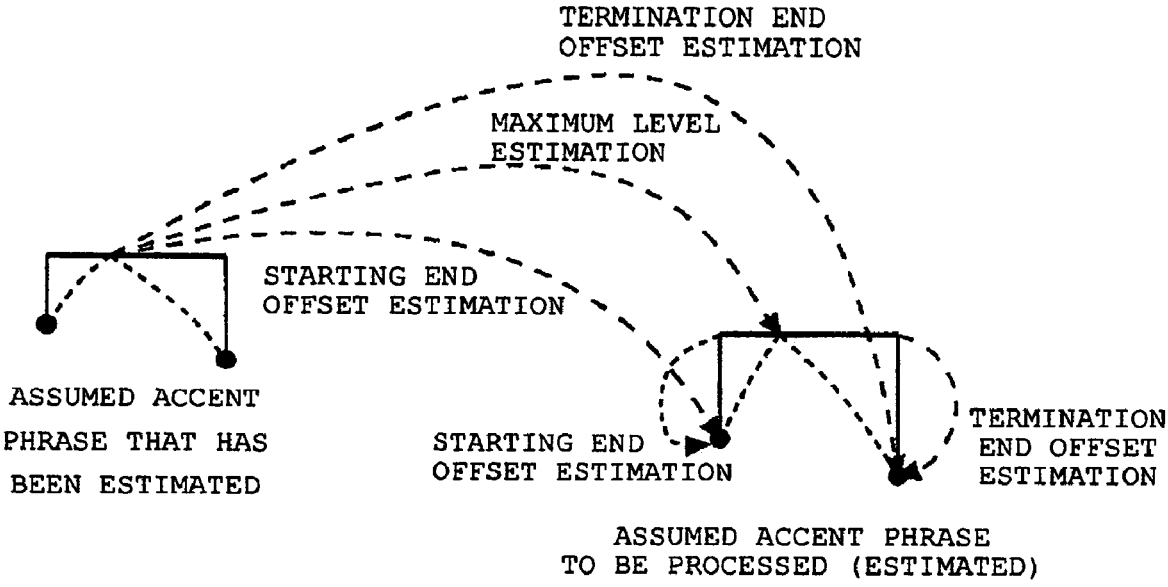
FIG. 3 is a view explaining a technique of incorporating limitations on a speech into an estimation model when estimating an F0 shape target in this embodiment.

FIG. 3 is a view explaining a technique of incorporating the limitations on the speech into the estimation model. As shown in FIG. 3, for the estimation of the maximum F0 value in the assumed accent phrase for which the estimation is being executed (currently assumed accent phrase), the maximum F0 value in the assumed accent phrase immediately therebefore, for which the estimation has been already finished, is incorporated. Moreover, for the estimation of the starting end offset and the termination end offset in the currently assumed accent phrase, the maximum F0 value in the assumed accent phrase immediately therebefore and the maximum F0 value in the currently assumed accent phrase are incorporated.

Note that the learning of the estimation model in the outline estimation section 21 is performed by categorizing an actual measurement value of the maximum F0 value obtained for each assumed accent phrase. Specifically, as an estimation factor in the case of estimating the F0 shape target, the outline estimation section 21 adds a category of the actual measurement value of the maximum F0 value in each assumed accent phrase to the prosodic category based on the above-described language information, thus executing statistical processing for the estimation.

The optimum shape element selection section 22 selects candidates for an F0 shape element to be applied to the currently assumed accent phrase under the processing from among the F0 shape elements (F0 patterns) accumulated in the F0 shape database 40. This selection includes a preliminary selection of roughly extracting F0 shape elements based on the F0 shape target estimated by the outline estimation section 21, and a selection of the optimum F0 shape element to be applied to the currently assumed accent phrase based on the phoneme class in the currently assumed accent phrase.

In the preliminary selection, the optimum shape element selection section 22 first acquires the F0 shape target in the currently assumed accent phrase, which has been estimated by the outline estimation section 21, and then calculates the distance between the starting and termination points by use of two parameters of the starting end offset and the termination end offset among the parameters defining the F0 shape target. Then, the optimum shape element selection section 22 selects, as the candidates for the optimum F0 shape element, all of the F0 shape elements for which the calculated distance between the starting and termination points is approximate to the distance between the starting and termination points in the F0 shape target (for example, the calculated distance is equal to or smaller than a preset threshold value). The selected F0 shape elements are ranked in accordance with distances thereof to the outline of the F0 shape target, and stored in the cache memory of the CPU 101 and the main memory 103.

Here, the distance between each of the F0 shape elements and the outline of the F0 shape target is a degree where the starting and termination point offsets among the parameters defining the F0 shape target and values equivalent to the parameters in the selected F0 shape element are approximate to each other. By these two parameters, a difference in shape between the F0 shape element and the F0 shape target is expressed.

Next, the optimum shape element selection section 22 calculates a distance of the phoneme class configuring the currently assumed accent phrase for each of the F0 shape elements that are the candidates for the optimum F0 shape element, the F0 shape elements being ranked in accordance with the distances to the target outline by the preliminary selection. Here, the distance of the phoneme class is a degree of approximation between the F0 shape element and the currently assumed accent phrase in an array of phonemes. For evaluating this array of phonemes, the phoneme class defined for each mora is used. This phoneme class is one formed by classifying the morae in consideration of the presence of consonants and a difference in a mode of tuning the consonants.

Specifically, here, degrees of consistency of the phoneme classes with the mora series in the currently assumed accent phrase are calculated for all of the F0 shape elements selected in the preliminary selection, the distances of the phoneme classes are obtained, and the array of the phonemes of each F0 shape element is evaluated. Then, an F0 shape element in which the obtained distance of the phoneme class is the smallest is selected as the optimum F0 shape element. This collation, using the distances among the phoneme classes, reflects that the F0 shape is prone to be influenced by the phonemes configuring the assumed accent phrase corresponding to the F0 shape element. The selected F0 shape element is stored in the cache memory of the CPU 101 or the main memory 103.

The shape element connection section 23 acquires and sequentially connects the optimum F0 shape elements selected by the optimum shape element selection section 22, and obtains a final intonation pattern for one sentence, which is a processing unit in the prosody control unit 20.

Concretely, the connection of the optimum F0 shape elements is performed by the following two processings.

First, the selected optimum F0 shape elements are set at an appropriate frequency level. This is to match the maximum values of frequency level in the selected optimum F0 shape elements with the maximum F0 values in the segments of the corresponding assumed accent phrase obtained by the processing performed by the outline estimation section 21. In this case, the shapes of the optimum F0 shape elements are not deformed at all.

Next, the shape element connection section 23 adjusts the time axes of the F0 shape elements for each mora so as to be matched with the time arrangement of a phoneme string to be synthesized. Here, the time arrangement of the phoneme string to be synthesized is represented by a duration length of each phoneme set based on the phoneme string of the target text. This time arrangement of the phoneme string is set by a phoneme duration estimation module from the existing technology (not shown).

Finally, at this stage, the actual pattern of F0 (the intonation pattern by the actual speech) is deformed. However, in this embodiment, the optimum F0 shape elements are selected by the optimum shape element selection section 22 using the distances among the phoneme classes, and accordingly, excessive deformation is difficult to occur for the F0 pattern.

In a manner as described above, the intonation pattern for the whole of the target text is generated and outputted to the speech generation unit 30.

As described above, in this embodiment, the F0 shape element in which the pattern shape is the most approximate to that of the F0 shape target is selected from among the whole of the F0 shape elements accumulated in the F0 shape database 40 without depending on the prosodic categories. Then, the selected F0 shape element is applied as the intonation pattern of the assumed accent phrase. Specifically, the F0 shape element selected as the optimum F0 shape element is separated away from the language information such as the positions of the accents and the presence of the pauses, and is selected only based on the shapes of the F0 patterns.

Therefore, the F0 shape elements accumulated in the F0 shape database 40 can be effectively utilized without being influenced by the language information from the viewpoint of the generation of the intonation pattern.

Furthermore, the prosodic categories are not considered when selecting the F0 shape element. Accordingly, even if a prosodic category adapted to a predetermined assumed accent is not present when text of open data is subjected to the speech synthesis, the F0 shape element corresponding to the F0 shape target can be selected and applied to the assumed accent phrase. In this case, the assumed accent phrase does not correspond to the existing prosodic category, and accordingly, it is likely that accuracy in the estimation itself for the F0 shape target will be lowered. However, while the F0 patterns stored in the database have not heretofore been appropriately applied, since the prosodic categories cannot be classified in such a case as described above, according to this embodiment, the retrieval is performed only based on the pattern shapes of the F0 shape elements. Accordingly, an appropriate F0 shape element can be selected within a range of the estimated accuracy for the F0 shape target.

Moreover, in this embodiment, the optimum F0 shape element is selected from among the whole of the F0 shape elements for actual speech, which are accumulated in the F0 shape database 40, without performing the equation processing and modeling. Hence, though the F0 shape elements are somewhat deformed by the adjustment of the time axes in the shape element connection section 23, the detail of the F0 pattern for actual speech can be reflected on the synthesized speech more faithfully.

For this reason, the intonation pattern, which is close to the actual speech and highly natural, can be generated. Particularly, speech characteristics (habit of a speaker) occurring due to a delicate difference in intonation, such as a rise of the pitch of the ending and an extension of the ending, can be reproduced flexibly and accurately.

Thus, the F0 shape database which accumulates the F0 shape elements of speeches with emotion and the F0 shape database which accumulates F0 shape elements of special speeches characterizing specific characters which are made in dubbing an animation film are prepared in advance and are switched appropriately for use, thus making it possible to synthesize various speeches which have different speech characteristics.

Figure 4:
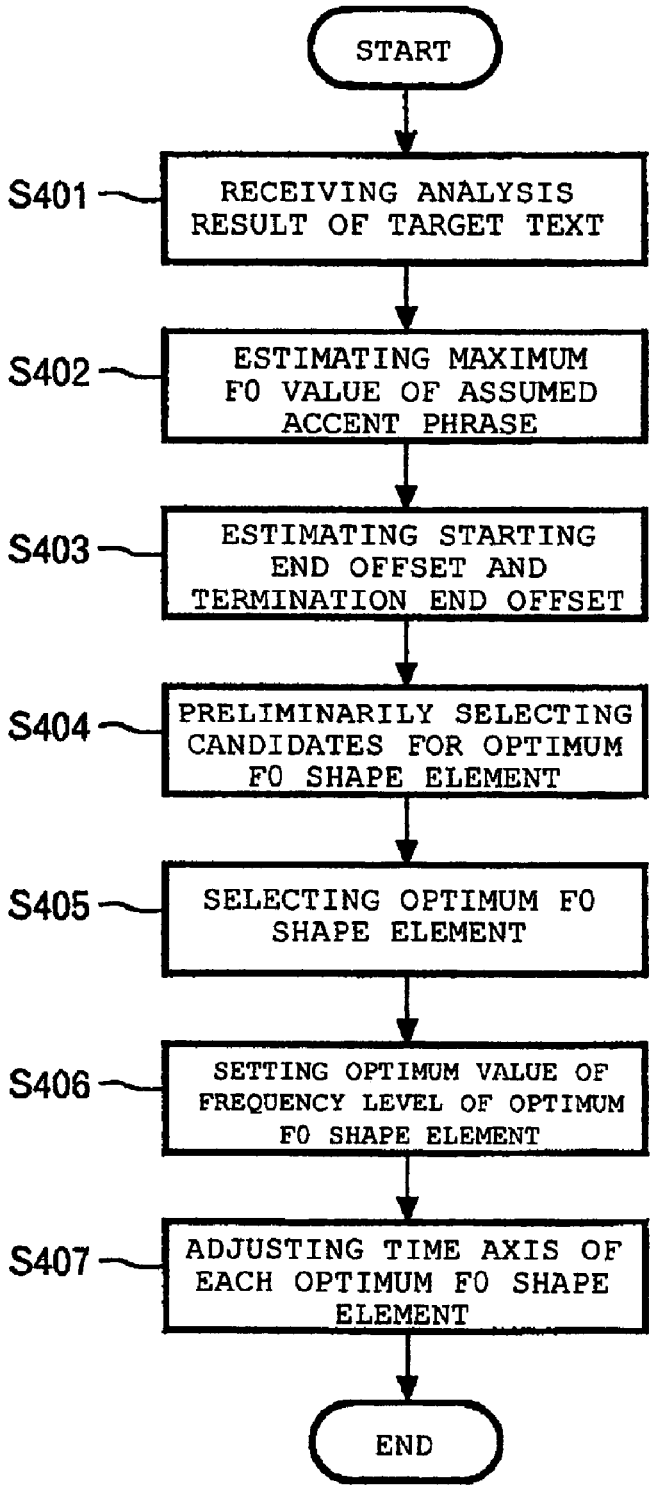
FIG. 4 is a flowchart explaining a flow of an operation of a speech synthesis by a prosody control unit according to this embodiment.
Figure 6:
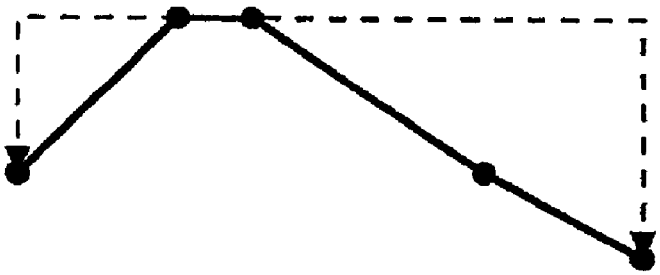
FIG. 6 is a view showing an example of a pattern shape in the optimum F0 shape element selected by an optimum shape element selection section of this embodiment.
Figure 7:
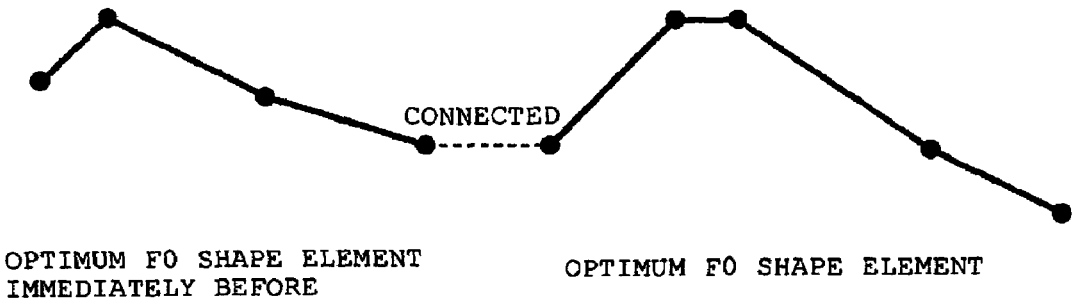
FIG. 7 shows a state of connecting the F0 pattern of the optimum F0 shape element, which is shown in FIG. 6, with an F0 pattern of an assumed accent phrase located immediately therebefore.

FIG. 4 is a flowchart explaining a flow of the operation of speech synthesis by the above-described prosody control unit 20. Moreover, FIGS. 5 to 7 are views showing shapes of F0 patterns acquired in the respective steps of the operation shown in FIG. 4.

As shown in FIG. 4, upon receiving an analysis result by the text analysis unit 20 with regard to a target text (Step 401), the prosody control unit 20 first estimates an F0 shape target for each assumed accent phrase by the outline estimation section 21.

Specifically, the maximum F0 value in the segments of the assumed accent phrases is estimated based on the language information that is the analysis result by the text analysis unit 10 (Step 402); and, subsequently, the starting and termination point offsets are estimated based on the maximum F0 value determined by the language information in Step 402 (Step 403). This estimation of the F0 shape target is sequentially performed for assumed accent phrases configuring the target text from a head thereof. Hence, with regard to the second assumed accent phrase and beyond, assumed accent phrases that have already been subjected to the estimation processing are present immediately therebefore, and therefore, estimation results for the preceding assumed accent phrases are utilized for the estimation of the maximum F0 value and the starting and termination offsets as described above.

Figure 5:
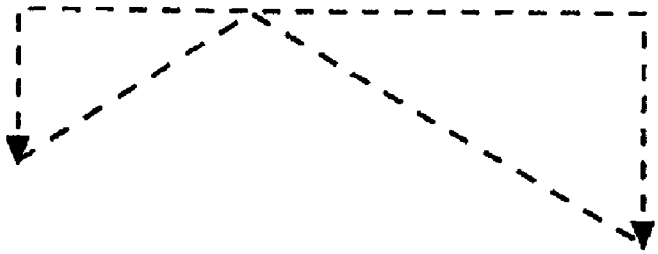
FIG. 5 is a view showing an example of a pattern shape in an F0 shape target estimated by an outline estimation section of this embodiment.

FIG. 5 shows an example of the pattern shape in the F0 shape target thus obtained. Next, a preliminary selection is performed for the assumed accent phrases by the optimum shape element selection section 22 based on the F0 shape target (Step 404) Concretely, F0 shape elements approximate to the F0 shape target in distance between the starting and termination points are detected as candidates for the optimum F0 shape element from the F0 shape database 40. Then, for all of the selected F0 elements, two-dimensional vectors having, as elements, the starting and termination point offsets are defined as shape vectors. Next, distances among the shape vectors are calculated for the F0 shape target and the respective F0 shape elements, and the F0 shape elements are sorted in an ascending order of the distances.

Next, the arrays of phonemes are evaluated for the candidates for the optimum F0 shape element, which have been extracted by the preliminary selection, and an F0 shape element in which the distance of the phoneme class to the array of phonemes is the smallest in the assumed accent phrase corresponding to the F0 shape target is selected as the optimum F0 shape element (Step 405). FIG. 6 shows an example of a pattern shape in the optimum F0 shape element thus selected.

Thereafter, the optimum F0 shape elements selected for the respective assumed accent phrases are connected to one another by the shape element connection section 23. Specifically, the maximum value of the frequency level of each of the optimum F0 shape element is set so as to be matched with the maximum F0 value of the corresponding F0 shape target (Step 406), and subsequently, the time axis of each of the optimum F0 shape elements is adjusted so as to be matched with the time arrangement of the phoneme string to be synthesized (Step 407). FIG. 7 shows a state of connecting the F0 pattern of the optimum F0 shape element, which is shown in FIG. 6, with the F0 pattern of the assumed accent phrase located immediately therebefore.

Figure 8:
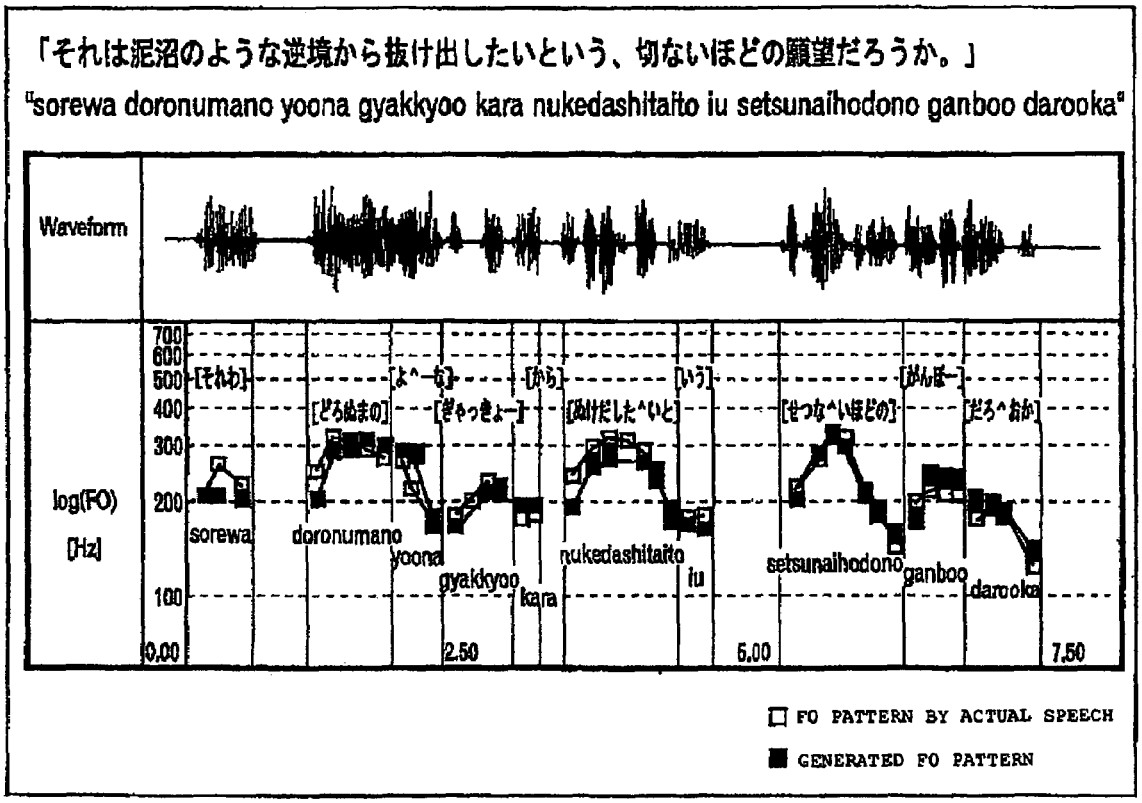
FIG. 8 shows a comparative example of an intonation pattern generated according to this embodiment and an intonation pattern by actual speech.

Next, a concrete example of applying this embodiment to actual text to generate an intonation pattern will be described. FIG. 8 is a view showing a comparative example of the intonation pattern generated according to this embodiment and an intonation pattern by actual speech.

In FIG. 8, intonation patterns regarding the text "sorewa doronumano yoona gyakkyoo kara nukedashitaito iu setsunaihodono ganboo darooka" are compared with each other.

As illustrated, this text is parsed into ten assumed accent phrases, which are: "sorewa"; "doronumano"; "yo^ona"; "gyakkyoo"; "kara"; "nukedashita^ito"; "iu"; "setsuna^ihodono"; "ganboo"; and "daroˆoka". Then, the optimum F0 shape elements are detected for the respective assumed accent phrases as targets.

FIG. 9 is a table showing the optimum F0 shape elements selected for each of the assumed accent phrases by use of this embodiment. In the column of each assumed accent phrase, the upper row indicates an environmental attribute of the inputted assumed accent phrase, and the lower row indicates attribute information of the selected optimum F0 shape element.

Referring to FIG. 9, the following F0 shape elements are selected for the above-described assumed accent phrases, that is, "korega" for "sorewa", "yorokobimo" for "doronumano", "maˆkki" for "yoˆona", "shukkin" for "gyakkyo", "yobi" for "kara", "nejimagetaˆnoda" for "nukedashitaˆito", "iu" for "iu, "juppuˆnkanno" for "setsunaˆihodono", "hanbai" for "ganboo", and "mieˆruto" for "daroˆoka".

An intonation pattern of the whole text, which is obtained by connecting the F0 shape elements, becomes one extremely close to the intonation pattern of the text in the actual speech as shown in FIG. 8.

The speech synthesis system which synthesizes the speech in a manner as described above can be utilized for a variety of systems using the synthesized speeches as outputs and for services using such systems. For example, the speech synthesis system of this embodiment can be used as a TTS (Text-to-speech Synthesis) engine of a voice server which provides a telephone-ready service for an access from a telephone network.

Figure 10:
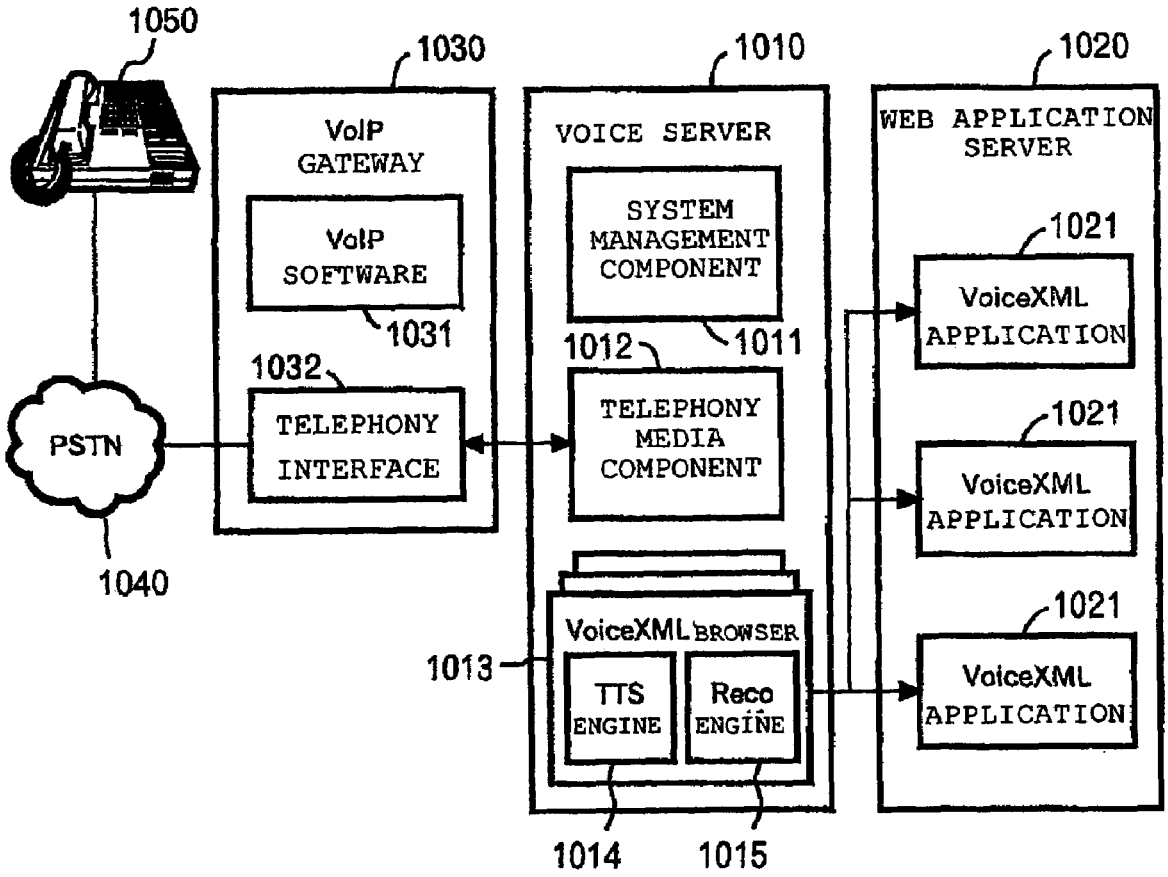
FIG. 10 shows a configuration example of a voice server implementing the speech synthesis system of this embodiment thereon.

FIG. 10 is a view showing a configuration example of a voice server which implements the speech synthesis system of this embodiment thereon. A voice server 1010 shown in FIG. 10 is connected to a Web application server 1020 and to a telephone network (PSTN: Public Switched Telephone Network) 1040 through a VoIP (Voice over IP) gateway 1030, thus providing the telephone-ready service.

Note that, though the voice server 1010, the Web application server 1020 and the VoIP gateway 1030 are prepared individually in the configuration shown in FIG. 10, it is also possible to make a configuration by providing the respective functions in one piece of hardware (computer apparatus) in an actual case.

The voice server 1010 is a server which provides a service by a speech dialogue for an access made through the telephone network 1040, and is realized by a personal computer, a workstation, or other computer apparatus. As shown in FIG. 10, the voice server 1010 includes a system management component 1011, a telephony media component 1012, and a Voice XML (Voice Extensible Markup Language) browser 1013, which are realized by the hardware and software of the computer apparatus.

The Web application server 1020 stores VoiceXML applications 1021 that are a group of telephone-ready applications described in VoiceXML.

Moreover, the VoIP gateway 1030 receives an access from the existing telephone network 1040, and so as to provide therefor a voice service directed to an IP (Internet Protocol) network by the voice server 1010, performs processing by converting the received access and connecting the same access thereto. In order to realize this function, the VoIP gateway 1030 mainly includes VoIP software 1031 as an interface with an IP network, and a telephony interface 1032 as an interface with the telephone network 1040.

With this configuration, the text analysis unit 10, the prosody control unit 20 and the speech synthesis unit 30 in this embodiment, which are shown in FIG. 2, are realized as a function of the VoiceXML browser 1013 as described later. Then, instead of outputting a voice from the speaker 111 shown in FIG. 1, a speech signal is outputted to the telephone network 1040 through the VoIP gateway 1030. Moreover, though not illustrated in FIG. 10, the voice server 1010 includes data storing means which is equivalent to the F0 shape database 40 and stores the F0 patterns in the intonations of the actual speech. The data storing means is referred to in the event of the speech synthesis by the VoiceXML browser 1013.

In the configuration of the voice server 1010, the system management component 1011 performs activation, halting and monitoring of the Voice XML browser 1013.

The telephony media component 1012 performs dialogue management for telephone calls between the VoIP gateway 1030 and the VoiceXML browser 1013. The VoiceXML browser 1013 is activated by origination of a telephone call from a telephone set 1050, which is received through the telephone network 1040 and the VoIP gateway 1030, and executes the VoiceXML applications 1021 on the Web application server 1020. Here, the VoiceXML browser 1013 includes a TTS engine 1014 and a Reco engine 1015 in order to execute this dialogue processing.

The TTS engine 1014 performs processing of the text-to-speech synthesis for text outputted by the VoiceXML applications 1021. As this TTS engine 1014, the speech synthesis system of this embodiment is used. The Reco engine 1015 recognizes a telephone voice inputted through the telephone network 1040 and the VoIP gateway 1030.

In a system which includes the voice server 1010 configured as described above and which provides the telephone-ready service, when a telephone call is originated from the telephone set 1050 and access is made to the voice server 1010 through the telephone network 1040 and the VoIP gateway 1030, the VoiceXML browser 1013 executes the VoiceXML applications 1021 on the Web application server 1020 under control of the system management component 1011 and the telephony media component 1012. Then, the dialogue processing in each call is executed in accordance with description of a VoiceXML document designated by the VoiceXML applications 1021.

In this dialogue processing, the TTS engine 1014 mounted in the VoiceXML browser 1013 estimates the F0 shape target by a function equivalent to that of the outline estimation section 21 of the prosody control unit 20 shown in FIG. 2, selects the optimum F0 shape element from the F0 shape database 40 by a function equivalent to that of the optimum shape element selection section 22, and connects the intonation patterns for each F0 shape element by a function equivalent to that of the shape element connection section 23, thus generating an intonation pattern in a sentence unit. Then, the TTS engine 1014 synthesizes a speech based on the generated intonation pattern, and outputs the speech to the VoIP gateway 1030.

Next, another embodiment for joining recorded speech and synthesized speech seamlessly and smoothly by use of the above-described speech synthesis technique will be described.

Figure 11:
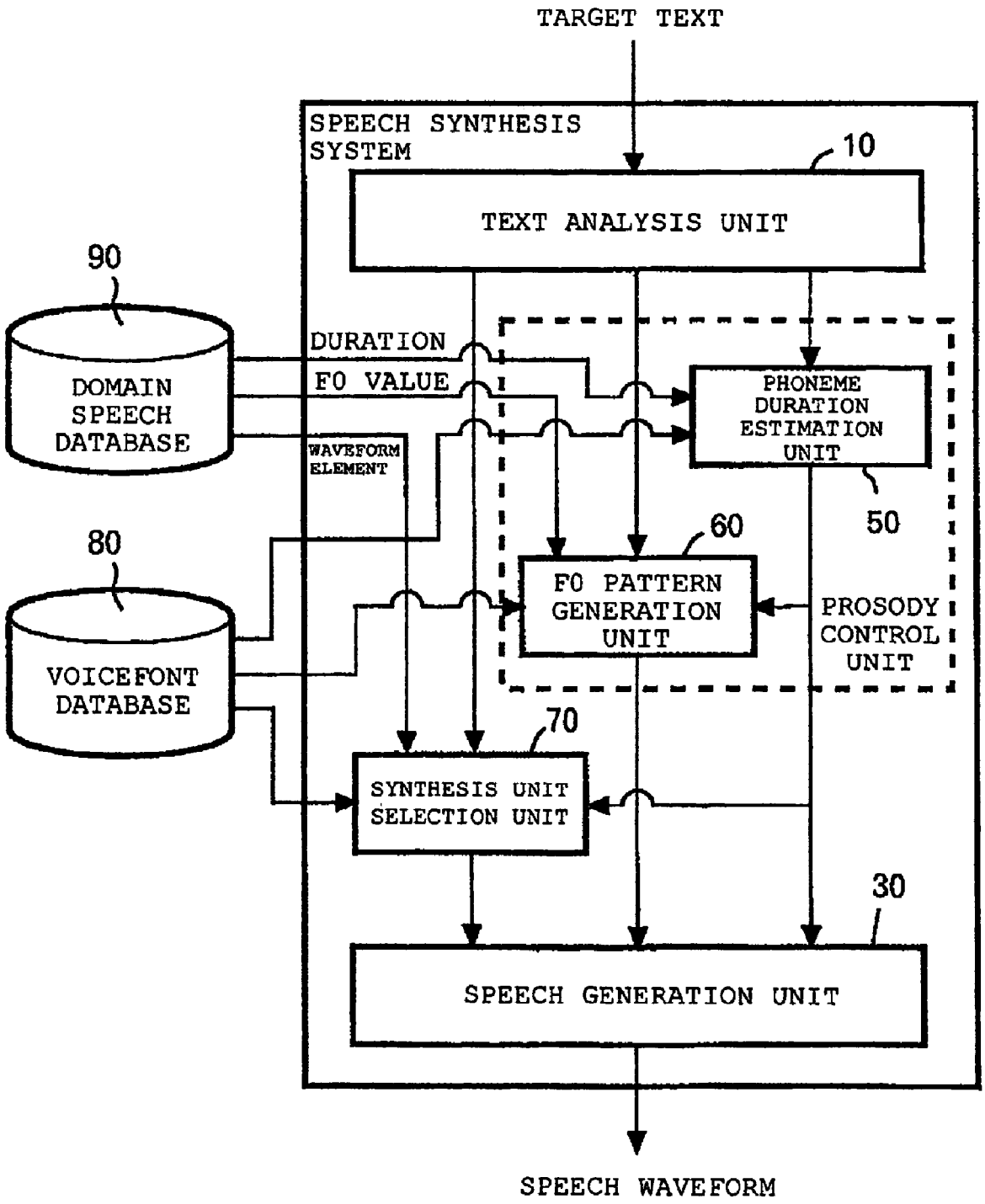
FIG. 11 shows a configuration of a speech synthesis system according to another embodiment of the present invention.

FIG. 11 illustrates a speech synthesis system according to this embodiment. Referring to FIG. 11, the speech synthesis system of this embodiment includes a text analysis unit 10 which analyzes text that is a target of the speech synthesis, a phoneme duration estimation unit 50 and an F0 pattern generation unit 60 for generating prosodic characteristics (phoneme duration and F0 pattern) of a speech outputted, a synthesis unit selection unit 70 for generating acoustic characteristics (synthesis unit element) of the speech outputted, and a speech generation unit 30 which generates a speech waveform of the speech outputted. Moreover, the speech synthesis system includes a voicefont database 80 which stores voicefonts for use in the processing in the phoneme duration estimation unit 50, the F0 pattern generation unit 60 and the synthesis unit selection unit 70, and a domain speech database 90 which stores recorded speeches. Here, the phoneme duration estimation unit 50 and the F0 pattern generation unit 60 in FIG. 11 correspond to the prosody control unit 20 in FIG. 2, and the F0 pattern generation unit 60 has a function of the prosody control unit 20 shown in FIG. 2 (functions corresponding to those of the outline estimation section 21, the optimum shape element selection section 22 and the shape element connection section 23).

Note that the speech synthesis system of this embodiment is realized by the computer apparatus shown in FIG. 1 or the like, similarly to the speech synthesis system shown in FIG. 2.

In the configuration described above, the text analysis unit 10 and the speech generation unit 30 are similar to the corresponding constituent elements in the embodiment shown in FIG. 2. Hence, the same reference numerals are added to these units, and description thereof is omitted.

The phoneme duration estimation unit 50, the F0 pattern generation unit 60, and the synthesis unit selection unit 70 are virtual software blocks realized by controlling the CPU 101 by use of a program expanded in the main memory 103 shown in FIG. 1. The program which controls the CPU 101 to realize these functions can be provided by being stored in a magnetic disk, an optical disk, a semiconductor memory or other recording media and distributed, or by being delivered through a network.

Moreover, in the configuration of FIG. 11, the voicefont database 80 is realized by, for example, the hard disk 106 shown in FIG. 1, and information (voicefonts) concerning speech characteristics of a speaker, which is extracted from a speech corpus and created, is stored therein. Note that the F0 shape database 40 shown in FIG. 2 is included in this voicefont database 80.

For example, the domain speech database 90 is realized by the hard disk 106 shown in FIG. 1, and data concerning speeches recorded for applied tasks is stored therein. This domain speech database 90 is, so to speak, a user dictionary extended so as to contain the prosody and waveform of the recorded speech so far, and, as registration entries, information such as waveforms hierarchically classified and prosodic information are stored as well as information such as indices, pronunciations, accents, and parts of speech.

In this embodiment, the text analysis unit 10 subjects the text that is the processing target to language analysis, sends the phoneme information such as the pronunciations and the accents to the phoneme duration estimation unit 50, sends the F0 element segments (assumed accent segments) to the F0 pattern generation unit 60, and sends information of the phoneme strings of the text to the synthesis unit selection unit 70. Moreover, when performing the language analysis, it is investigated whether or not each phrase (corresponding to the assumed accent segment) is registered in the domain speech database 90. Then, when a registration entry is hit in the language analysis, the text analysis unit 10 notifies the phoneme duration estimation unit 50, the F0 pattern generation unit 60 and the synthesis unit selection unit 70 that prosodic characteristics (phoneme duration, F0 pattern) and acoustic characteristics (synthesis unit element) concerning the concerned phrase are present in the domain speech database 90.

The phoneme duration estimation unit 50 generates a duration (time arrangement) of a phoneme string to be synthesized based on the phoneme information received from the text analysis unit 10, and stores the generated duration in a predetermined region of the cache memory of the CPU 101 or the main memory 103. The duration is read out in the F0 pattern generation unit 60, the synthesis unit selection unit 70 and the speech generation unit 30, and is used for each processing. For the generation technique of the duration, a publicly known existing technology can be used.

Here, when it is notified from the text analysis unit 10 that a phrase corresponding to the F0 element segment, for which the durations are to be generated, is stored in the domain speech database 90, the phoneme duration estimation unit 50 accesses the domain speech database 90 to acquire durations of the concerned phrase therefrom, instead of generating the duration of the phoneme string relating to the concerned phrase, and stores the acquired durations in the predetermined region of the cache memory of the CPU 101 or the main memory 103 in order to be served for use by the F0 pattern generation unit 60, the synthesis unit selection unit 70 and the speech generation unit 30.

The F0 pattern generation unit 60 has a function similar to functions corresponding to the outline estimation section 21, the optimum shape element selection section 22 and the shape element connection section 23 in the prosody control unit 20 in the speech synthesis system shown in FIG. 2. The F0 pattern generation unit 60 reads the target text analyzed by the text analysis unit 10 in accordance with the F0 element segments, and applies thereto the F0 pattern of the intonation accumulated in a portion corresponding to the F0 shape database 40 in the voicefont database 80, thus generating the intonation of the target text. The generated intonation pattern is stored in the predetermined region of the cache memory of the CPU 101 or the main memory 103.

Here, when it is notified from the text analysis unit 10 that the phrase corresponding to the predetermined F0 element segment, for which the intonation is to be generated, is stored in the domain speech database 90, the function corresponding to the outline estimation section 21 in the F0 pattern generation unit 60 accesses the domain speech database 90, acquires an F0 value of the concerned phrase, and defines the acquired value as the outline of the F0 pattern instead of estimating the outline of the F0 pattern based on the language information and information concerning the existence of a pause.

As described with reference to FIG. 3, the outline estimation section 21 of the prosody control unit 20 in the speech processing system of FIG. 2 is adapted to reflect the estimation result for the segment of the assumed accent phrase immediately therebefore on the estimation of the F0 shape target for the segment (F0 element segment) of the assumed accent phrase under the processing. Hence, when the outline of the F0 pattern in the F0 element segment immediately therebefore is the F0 value acquired from the domain speech database 90, the F0 value of the recorded speech in the F0 element segment immediately therebefore will be reflected on the F0 shape target for the F0 element segment under the processing.

In addition to this, in this embodiment, when the F0 value acquired from the main speech database 90 is present immediately after the F0 element segment being processed, the F0 element segment immediately thereafter; that is, the F0 value, is further made to be reflected on the estimation of the F0 shape target for the F0 element segment under processing. Meanwhile, the estimation result of the outline of the F0 pattern, which has been obtained from the language information and the like, is not made to be reflected on the F0 value acquired from the domain speech database 90. In such a way, the speech characteristics of the recorded speech stored in the domain speech database 90 will still further be reflected on the intonation pattern generated by the F0 pattern generation unit 60.

Figure 12:
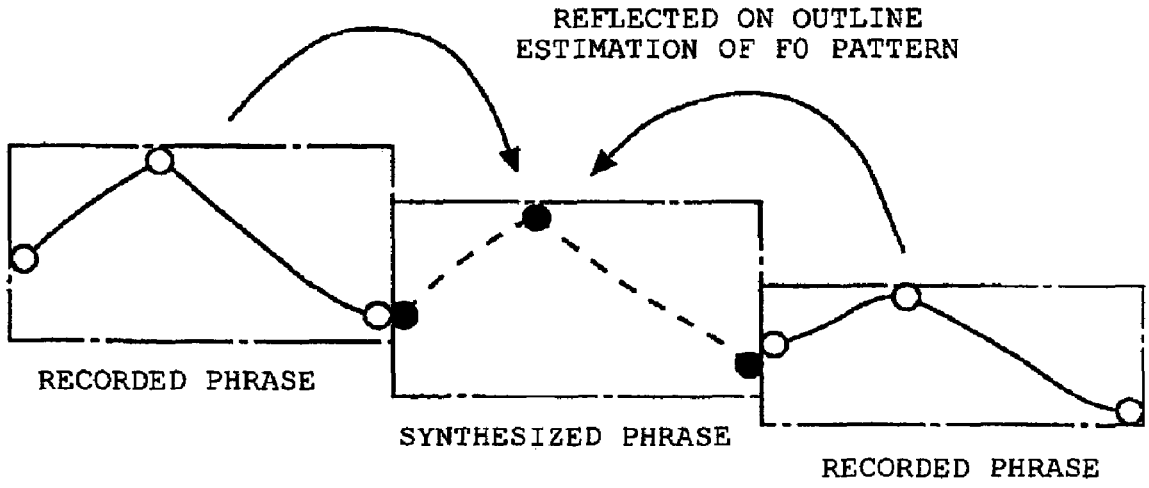
FIG. 12 is a view explaining an outline estimation of an F0 pattern in a case of inserting a phrase by synthesized speech between two phrases by recorded speeches in this embodiment.

FIG. 12 is a view explaining an outline estimation of the F0 pattern in the case of inserting a phrase by the synthesized speech between two phrases by the recorded speeches. As shown in FIG. 12, when the phrases by the recorded speeches are present before and after the assumed accent phrase by the synthesized speech for which the outline estimation of the F0 pattern is to be performed in a sandwiching manner, the maximum F0 value in the recorded speech before the assumed accent phrase and an F0 value in the recorded speech thereafter are incorporated in an estimation of the maximum F0 value and starting and termination point offsets of the assumed accent phrase by the synthesized speech.

Though not illustrated, in contrast, in the case of estimating outlines of F0 patterns of assumed accent phrases by the synthesized speeches which sandwich a predetermined phrase by the recorded speech, the maximum F0 value of the phrase by the recorded speech will be incorporated in the outline estimation of the F0 patterns in the assumed accent phrases before and after the predetermined phrase.

Furthermore, when phrases by the synthesized speeches continue, characteristics of an F0 value of a recorded speech located immediately before a preceding assumed accent phrase will be sequentially reflected on the respective assumed accent phrases.

Note that learning by the estimation model in the outline estimation of the F0 pattern is performed by categorizing an actual measurement value of the maximum F0 value obtained for each assumed accent phrase. Specifically, as an estimation factor in the case of estimating the F0 shape target in the outline estimation, a category of an actual measurement value of the maximum F0 value in each assumed accent phrase is added to the prosodic category based on the above-described language information, and statistical processing for the estimation is executed.

Thereafter, the F0 pattern generation unit 60 selects and sequentially connects the optimum F0 shape elements by the functions corresponding to the optimum shape element selection section 22 and shape element connection section 23 of the prosody control unit 20, which are shown in FIG. 2, and obtains an F0 pattern (intonation pattern) of a sentence that is a processing target.

Figure 13:
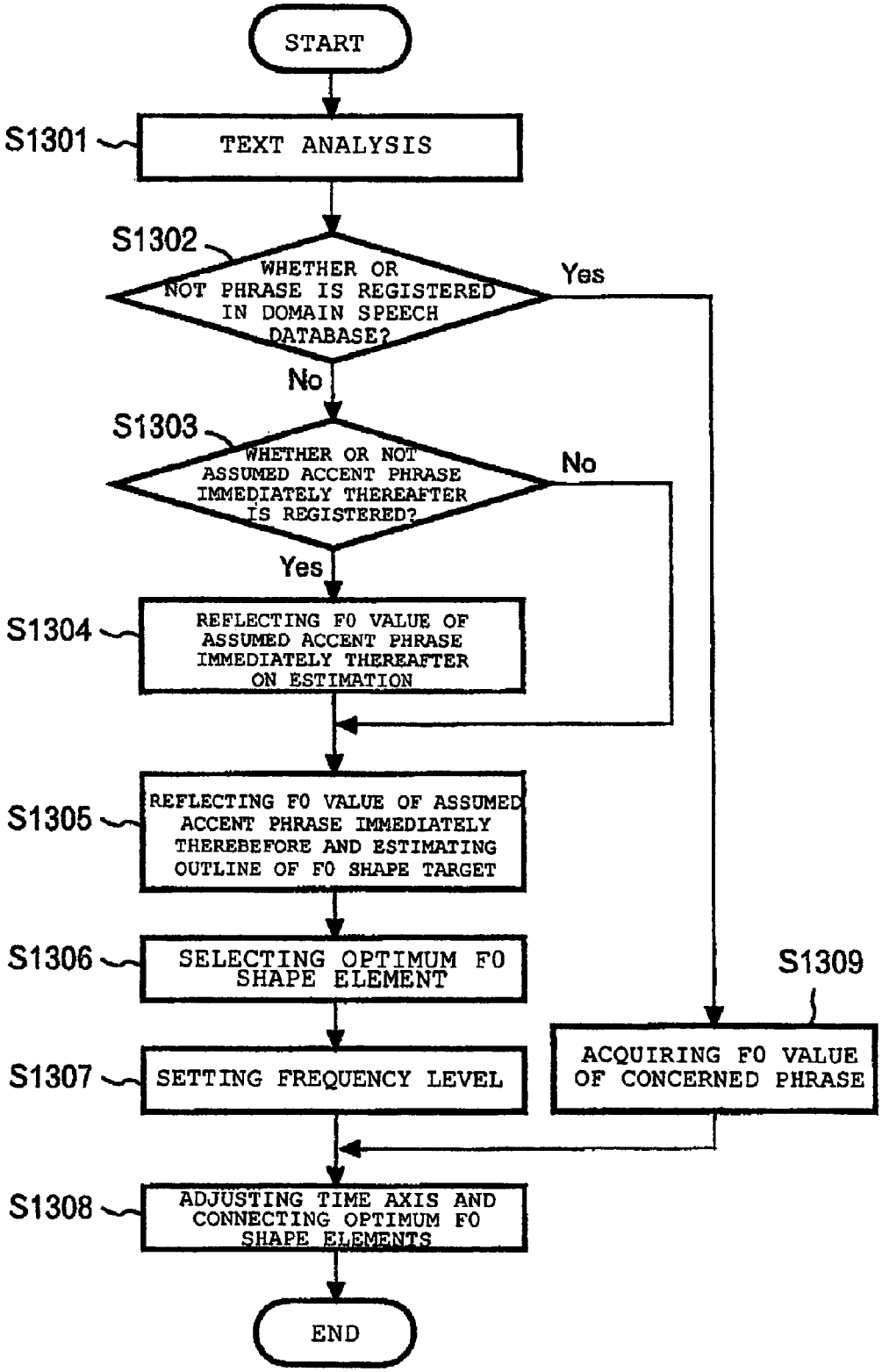
FIG. 13 is a flowchart explaining a flow of generation processing of an F0 pattern by an F0 pattern generation unit of this embodiment.

FIG. 13 is a flowchart illustrating generation of the F0 pattern by the F0 pattern generation unit 60. As shown in FIG. 13, first, in the text analysis unit 10, it is investigated whether or not a phrase corresponding to the F0 element segment that is a processing target is registered in the domain speech database 90 (Steps 1301 and 1302).

When the phrase corresponding to the F0 element segment that is the processing target is not registered in the domain speech database 90 (when a notice from the text analysis unit 10 is not received), the F0 pattern generation unit 60 investigates whether or not a phrase corresponding to an F0 element segment immediately after the F0 element segment under processing is registered in the domain speech database 90 (Step 1303). Then, when the concerned phrase is not registered, an outline of an F0 shape target for the F0 element segment under processing is estimated while reflecting a result of an outline estimation of an F0 shape target for the F0 element segment immediately therebefore (reflecting an F0 value of the concerned phrase when the phrase corresponding to the F0 element segment immediately therebefore is registered in the domain speech database 90) (Step 1305). Then, the optimum F0 shape element is selected (Step 1306), a frequency level of the selected optimum F0 shape element is set (Step 1307), a time axis is adjusted based on the information of duration, which has been obtained by the phoneme duration estimation unit 50, and the optimum F0 shape element is connected to another (Step 1308).

In Step 1303, when the phrase corresponding to the F0 element segment immediately after the F0 element segment under processing is registered in the domain speech database 90, the F0 value of the phrase corresponding to the F0 element segment immediately thereafter, which has been acquired from the domain speech database 90, is reflected in addition to the result of the outline estimation of the F0 shape target for the F0 element segment immediately therebefore. Then, the outline of the F0 shape target for the F0 element segment under processing is estimated (Steps 1304 and 1305). Then, as usual, the optimum F0 shape element is selected (Step 1306), the frequency level of the selected optimum F0 shape elements is set (Step 1307), the time axis is adjusted based on the information of duration, which has been obtained by the phoneme duration estimation unit 50, and the optimum F0 shape element is connected to the other (Step 1308).

Meanwhile, when the phrase corresponding to the F0 element segment that is the processing target is registered in the domain speech database 90 in Step 1302, instead of selecting the optimum F0 shape element by the above-described processing, the F0 value of the concerned phrase registered in the domain speech database 90 is acquired (Step 1309). Then, the acquired F0 value is used as the optimum F0 shape element, the time axis is adjusted based on the information of duration, which has been obtained in the phoneme duration estimation unit 50, and the optimum F0 shape element is connected to the other (Step 1308).

The intonation pattern of the whole sentence, which has been thus obtained, is stored in the predetermined region of the cache memory of the CPU 101 or the main memory 103.

The synthesis unit selection unit 70 receives the information of duration, which has been obtained by the phoneme duration estimation unit 50, and the F0 value of the intonation pattern, which has been obtained by the F0 pattern generation unit 60. Then, the synthesis unit selection unit 70 accesses the voicefont database 80, and selects and acquires the synthesis unit element (waveform element) of each voice in the F0 element segment that is the processing target. Here, in the actual speech, a voice of a boundary portion in a predetermined phrase is influenced by a voice and the existence of a pause in another phrase coupled thereto. Hence, the synthesis unit selection unit 70 selects a synthesis unit element of a sound of a boundary portion in a predetermined F0 element segment in accordance with the voice and the existence of the pause in the other F0 element segment connected thereto so as to smoothly connect the voices in the F0 element segment. Such an influence appears particularly significantly in a voice of a termination end portion of the phrase. Hence, it is preferable that at least the synthesis unit element of the sound of the termination end portion in the F0 element segment be selected in consideration of an influence of a sound of the starting end in the F0 element segment immediately thereafter. The selected synthesis unit element is stored in the predetermined region of the cache memory of the CPU 101 or the main memory 103.

Moreover, when it is notified that the phrase corresponding to the F0 element segment for which the synthesis unit element is to be generated is stored in the domain speech database 90, the synthesis unit selection unit 70 accesses the domain speech database 90 and acquires the waveform element of the corresponding phrase therefrom, instead of selecting the synthesis unit element from the voicefont database 80. Also in this case, similarly, the synthesis element is adjusted in accordance with a state immediately after the F0 element segment when the sound is a sound of a termination end of the F0 element segment. Specifically, the processing of the synthesis unit selection unit 70 is only to add the waveform element of the domain speech database 90 as a candidate for selection.

Figure 14:
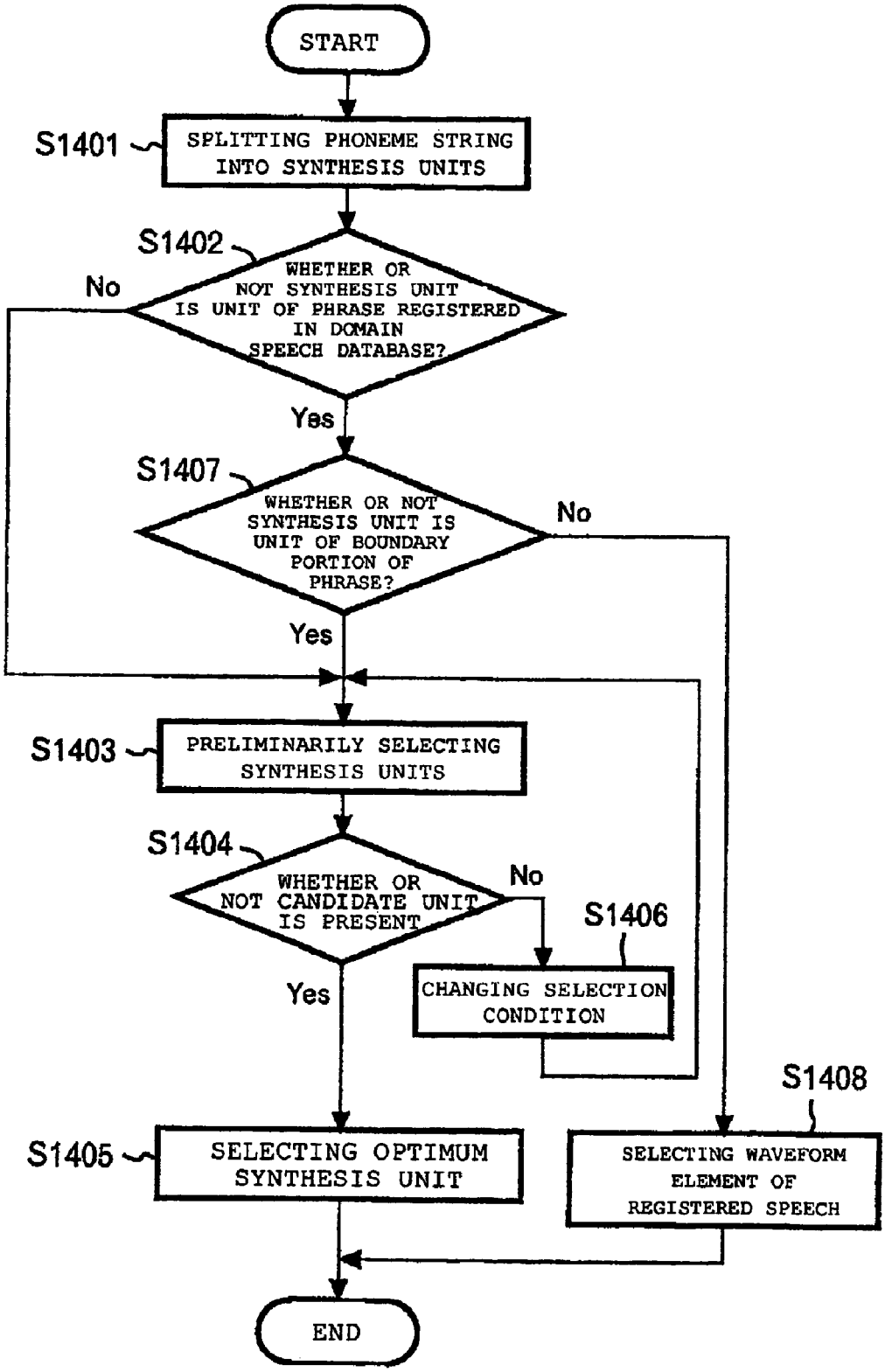
FIG. 14 is a flowchart explaining a flow of generation processing of a synthesis unit element by a synthesis unit selection unit of this embodiment.

FIG. 14 is a flowchart detailing processing by the synthesis unit element by the synthesis unit selection unit 70. As shown in FIG. 14, the synthesis unit selection unit 70 first splits a phoneme string of the text that is the processing target into synthesis units (at Step 1401), and investigates whether or not a synthesis unit to be focused is one corresponding to a phrase registered in the domain speech database 90 (Step 1402). Such a determination can be performed based on a notice from the text analysis unit 10.

When it is recognized that the phrase corresponding to the focused synthesis unit is not registered in the domain speech database 90, next, the synthesis unit selection unit 70 performs a preliminary selection for the synthesis unit (Step 1403). Here, the optimum synthesis unit elements to be synthesized are selected with reference to the voicefont database 80. As selection conditions, adaptability of a phonemic environment and adaptability of a prosodic environment are considered. The adaptability of the phonemic environment is the similarity between a phonemic environment obtained by analysis of the text analysis unit 10 and an original environment in phonemic data of each synthesis unit. Moreover, the adaptability of the prosodic environment is the similarity between the F0 value and duration of each phoneme given as a target and the F0 value and the duration in the phonemic data of each synthesis unit.

When an appropriate synthesis unit is discovered in the preliminary selection, the synthesis unit is selected as the optimum synthesis unit element (Steps 1404 and 1405). The selected synthesis unit element is stored in the predetermined region of the cache memory of the CPU 101 or main memory 103.

On the other hand, when the appropriate synthesis unit is not discovered, the selection condition is changed, and the preliminary selection is repeated until the appropriate synthesis unit is discovered (Steps 1404 and 1406).

In Step 1402, when it is determined that the phrase corresponding to the focused synthesis unit is registered in the domain speech database 90 based on the notice from the text analysis unit 10, then the synthesis unit selection unit 70 investigates whether or not the focused synthesis unit is a unit of a boundary portion of the concerned phrase (Step 1407). When the synthesis unit is the unit of the boundary portion, the synthesis unit selection unit 70 adds, to the candidates, the waveform element of the speech of the phrase, which is registered in the domain speech database 90, and executes the preliminary selection for the synthesis units (Step 1403). Processing that follows is similar to the processing for the synthesized speech (Steps 1404 to 1406).

On the other hand, when the focused synthesis unit is not the unit of the boundary portion, though this unit is contained in the phrase registered in the domain speech database 90, the synthesis unit selection unit 70 directly selects the waveform element of the speech stored in the domain speech database 90 as the synthesis unit element in order to faithfully reproduce the recorded speech in the phrase (Steps 1407 and 1408). The selected synthesis unit element is stored in the predetermined region of the cache memory of the CPU 101 or the main memory 103.

The speech generation unit 30 receives the information of the duration thus obtained by the phoneme duration estimation unit 50, the F0 value of the intonation pattern thus obtained by the F0 pattern generation unit 60, and the synthesis unit element thus obtained by the synthesis unit selection unit 70. Then, the speech generation unit 30 performs speech synthesis therefor by a waveform superposition method. The synthesized speech waveform is outputted as speech through the speaker 111 shown in FIG. 1.

As described above, according to this embodiment, the speech characteristics in the recorded actual speech can be fully reflected when generating the intonation pattern of the synthesized speech, and therefore, a synthesized speech closer to recorded actual speech can be generated.

Particularly, in this embodiment, the recorded speech is not directly used, but treated as data of the waveform and the prosodic information, and the speech is synthesized by use of the data of the recorded speech when the phrase registered as the recorded speech is detected in the text analysis. Therefore, the speech synthesis can be performed by the same processing as in the case of generating a free synthesized speech other than recorded speech; and, as for processing of the system, it is not necessary to be aware whether the speech is recorded speech or synthesized speech. Hence, development cost of the system can be reduced.

Moreover, in this embodiment, the value of the termination end offset in the F0 element segment is adjusted in accordance with the state immediately thereafter without differentiating the recorded speech and the synthesized speech. Therefore, a highly natural speech synthesis without a feeling of wrongness, in which the speeches corresponding to the respective F0 element segments are smoothly connected, can be performed.

As described above, according to the present invention, a speech synthesis system, of which speech synthesis is highly natural, and which is capable of reproducing the speech characteristics of a speaker flexibly and accurately, can be realized in the generation of the intonation pattern of the speech synthesis.

Moreover, according to the present invention, in speech synthesis, the F0 patterns are narrowed without depending on the prosodic category for the data base (corpus base) of the F0 patterns in the intonation of the actual speech, thus making it possible to effectively utilize the F0 patterns of the actual speech, which are accumulated in the database.

Furthermore, according to the present invention, speech synthesis in which the intonations of the recorded speech and synthesized speech are mixed appropriately and joined smoothly can be performed.

The invention claimed is:

1. A speech synthesis apparatus for performing a text-to-speech synthesis to generate synthesized speech, comprising:

a text analysis unit for performing linguistic analysis of input text as a processing target and acquiring language information therefrom and providing speech output to a prosody control unit;

a first database for storing intonation patterns of actual speech;

a prosody control unit for receiving speech output from the text analysis unit and for generating a prosody comprising determining pitch, length and intensity of a sound for each phoneme comprising said speech and a rhythm of speech with positions of pauses for audibly outputting the text and providing the prosody to a speech generation unit; and a speech generation unit for receiving the prosody from the prosody control unit and for generating synthesized speech based on the prosody generated by the prosody control unit, wherein the prosody control unit includes:

an outline estimation section for estimating an outline of an intonation for each assumed accent phrase configuring the text based on language information acquired by the text analysis unit, wherein the outline estimation section defines the outline of the intonation at least by a maximum value of a frequency level in a segment of the assumed accent phrase and relative level offsets in a starting end and termination end of the segment;

a shape element selection section for selecting an intonation pattern from the database based on the outline of the intonation, the outline having been estimated by the outline estimation section and wherein the shape element selection section selects an intonation pattern approximate in shape to the outline of the information, the outline having been estimated by the outline intonation section, among the intonation patterns of the actual speech, the intonation patterns having been accumulated in the database; and a shape element connection section for connecting the intonation pattern for each assumed accent phrase to the intonation pattern for another assumed accent phrase, each intonation pattern having been selected by the shape element selection section, to generate an intonation pattern of an entire body of the text, wherein the shape element connection section connects the intonation pattern for each assumed accent phrase to the other, the intonation pattern having been selected by the shape element selection section, after adjusting a frequency level of the assumed accent phrase based on the outline of the intonation, the outline having been estimated by the outline estimation section.

2. The speech synthesis apparatus of claim 1 further comprising a second database which stores information concerning intonations of a speech recorded in advance, wherein, when the assumed accent phrase is present in a recorded phrase registered in the second database, the outline estimation section acquires information concerning an intonation of a portion corresponding to the assumed accent phrase of the recorded phrase from the second database and estimates an outline of an intonation for the assumed accent phrase based on an estimation result of an outline of an intonation for the other assumed accent phrase corresponding to the phrase of the recorded speech.

* * * * *